US008479879B2

(12) United States Patent
Hawwa

(10) Patent No.: US 8,479,879 B2
(45) Date of Patent: Jul. 9, 2013

(54) EXPANDABLE CHAMBER ACOUSTIC SILENCER

(75) Inventor: Muhammad A. Hawwa, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 155 days.

(21) Appl. No.: 13/159,278

(22) Filed: Jun. 13, 2011

(65) Prior Publication Data

US 2012/0312629 A1 Dec. 13, 2012

(51) Int. Cl.

| | |
|---|---|
| ***F01N 1/00*** | (2006.01) |
| ***F01N 1/16*** | (2006.01) |
| ***F01N 5/00*** | (2006.01) |
| ***F01N 13/18*** | (2010.01) |
| ***F02B 27/02*** | (2006.01) |

(52) U.S. Cl.

USPC ..... 181/271; 181/212; 181/241; 181/254; 60/312

(58) Field of Classification Search

USPC ..... 181/271, 212, 241, 254; 60/312

See application file for complete search history.

(56) References Cited

U.S. PATENT DOCUMENTS

| | | | | | |
|---|---|---|---|---|---|
| 3,219,141 | A * | 11/1965 | Williamitis | ..... | 181/269 |
| 3,642,095 | A * | 2/1972 | Fujii | ..... | 181/271 |
| 4,549,467 | A * | 10/1985 | Wilden et al. | ..... | 91/307 |
| 5,271,224 | A * | 12/1993 | Cruickshank | ..... | 60/314 |
| 5,457,749 | A * | 10/1995 | Cain et al. | ..... | 381/71.5 |
| 5,693,918 | A * | 12/1997 | Bremigan et al. | ..... | 181/206 |
| 5,821,475 | A * | 10/1998 | Morehead et al. | ..... | 181/255 |
| 6,105,716 | A * | 8/2000 | Morehead et al. | ..... | 181/255 |
| 6,296,074 | B1 | 10/2001 | Ridlen | | |
| 6,499,562 | B1 * | 12/2002 | Elfinger et al. | ..... | 181/251 |
| 6,598,390 | B2 * | 7/2003 | Chang | ..... | 60/323 |
| 6,769,511 | B1 * | 8/2004 | Brooks et al. | ..... | 181/241 |
| 7,255,197 | B2 | 8/2007 | Horiko | | |
| 7,610,993 | B2 * | 11/2009 | Sullivan | ..... | 181/268 |
| 7,753,165 | B2 | 7/2010 | Kassner | | |
| 7,905,319 | B2 * | 3/2011 | Sullivan | ..... | 181/250 |
| 2004/0118632 | A1 * | 6/2004 | Ciray | ..... | 181/219 |
| 2007/0164641 | A1 * | 7/2007 | Pelrine et al. | ..... | 310/800 |

* cited by examiner

*Primary Examiner* — David Warren
*Assistant Examiner* — Christina Russell
(74) *Attorney, Agent, or Firm* — Richard C. Litman

(57) ABSTRACT

The expandable chamber acoustic silencer may be installed at the inlet or outlet of virtually any mechanism that processes air or other gas flow therethrough, to reduce the audible output of the gas flow. The silencer may be used to reduce the noise produced in an air conditioning system, in the inlet or outlet side of an air compressor, or as a muffler for an internal combustion engine, among other applications. The device includes an expansion chamber having adjustable walls driven by actuators installed within the walls to adjust the cross-sectional area of the chamber, with a portion of the walls being formed of a flexible or resilient material to enable such expansion and retraction. One or more microphones are installed at the outlet and/or inlet ends of the silencer and communicate with a controller that operates the actuators in accordance with a predetermined algorithm.

11 Claims, 7 Drawing Sheets

EXPANDABLE CHAMBER ACOUSTIC SILENCER

BACKGROUND OF THE INVENTION

1. Field of the Invention

The present invention relates generally to sound attenuation devices, and particularly to an expandable chamber acoustic silencer having a variable cross-sectional area controlled in accordance with signals received from a controller.

2. Description of the Related Art

It is well known that air or other gas flow and/or expansion in or from a closed system results in the production of sound. This may be a desirable outcome, and certain devices (e.g., musical instruments, sirens, etc.) are deliberately configured to produce an audible output. However, many other devices produce an audible output(s) as an unintentional side effect of their operation. Examples include air conditioning systems having fan or blower supplied airflow and intake systems for air compressors and internal combustion engines. Internal combustion engines are also well known to produce relatively loud and obtrusive exhaust noise due to the expansion of the heated gases used to produce the power output developed by the engine.

In many cases the audible output of the device is quite variable, depending upon the amount of air or gas flow through the device, among other factors. Generally speaking, the greater the air or gas flow through the device, the louder the sound output, although the operating frequency (e.g., the RPM of an internal combustion engine) and system resonance(s) also have a great deal of effect. In many cases, particularly in the field of musical instruments, the audible output may be varied in tone and/or intensity by varying the internal cross-sectional area of the instrument relative to the inlet and/or outlet cross-sectional areas.

In the above examples, where audible output is an undesired side effect of the operation of the device, e.g., in air compressors and engines, innumerable devices have been developed in the past to reduce the sound output of such devices. Most such devices are formed of relatively thin sheet metal and have a labyrinthine path therein for the air or gas to follow. Others rely upon some form of porous barrier that may also serve as a filtration system for incoming air to the system. Still others may utilize some form of active control, e.g., generating sound that is out of phase with the undesired sound output so that the generated sound substantially cancels the sound output of the device that produces the unwanted sound. Such systems not only require microphones to receive the sound output of the machine, but also require some form of audible output device (i.e., a speaker or speakers) to produce the out of phase audible signal to cancel the unwanted sound.

While such devices are effective to some degree, none have proven entirely satisfactory. Thus, an expandable chamber acoustic silencer solving the aforementioned problems is desired.

SUMMARY OF THE INVENTION

The expandable chamber acoustic silencer comprises various embodiments of a reactive silencer or muffler that detects the sound input and/or output of a device by means of microphone pickups, and uses those detected sounds to direct mechanisms that adjust the cross-sectional area of an expansion chamber to change its resonant frequency in accordance with the detected sound input, thereby substantially canceling the sound input to the muffler or silencer. Certain embodiments may have a sound detection microphone at only the output end of the silencer device, while other embodiments may include such microphones at both the input and the output of the device. The muffler or silencer may be formed to have virtually any practicable shape and interior gas flow path, but all embodiments include a relatively thick wall with actuators installed therein. The actuators extend or retract in accordance with signals from a controller to drive sections of the wall outward or inward, thereby adjusting the cross-sectional area of the muffler or silencer relative to its inlet and/or outlet cross-sectional areas to change its resonant frequency and substantially cancel the sound being input to the muffler or silencer device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The expandable chamber acoustic silencer comprises various embodiments of a reactive-type silencer of the expansion chamber variety that serves to reduce the audible output of various mechanical devices, such as air compressors, air conditioning systems, internal combustion engines, and other devices that process or transfer air or other gases therethrough during their operation. Silencers are classified into two categories: (a) the passive type, and (b) the active type.

The passive type includes silencers where the sound is attenuated by absorption or reflection of the acoustic energy within the silencer. Two subcategories of the passive type are: (i) dissipative silencers, which contain sound absorptive material capable of converting sound energy into heat; and (ii) reactive silencers (such as expansion chambers and side branch resonators), which depend on the reflection or expansion of sound waves with corresponding self-destruction as a noise reduction mechanism. A combination of dissipative and reactive silencers is noted in practice, the automotive muffler being a common example.

The active-type silencer is a silencer in which the noise is cancelled by electronically generating an "anti-noise" field, which is superimposed on the noise field. With careful matching of amplitude and phase using feedforward and feedback control techniques, a cancellation process results, with lower noise levels.

The expandable chamber acoustic silencer is a reactive-type silencer, based on reflective self-destruction of unwanted acoustic waves. The silencer associated with these devices may be known by the term "silencer," "muffler," or similar term indicating its sound attenuation properties, the term "muffler" commonly being used for such devices used with internal combustion engines. Each of the embodiments of the silencer includes at least one movable wall that adjusts the cross-sectional area of the expansion chamber using a controller and at least one actuator controlling the positioning of the movable wall(s).

Figure 1A:
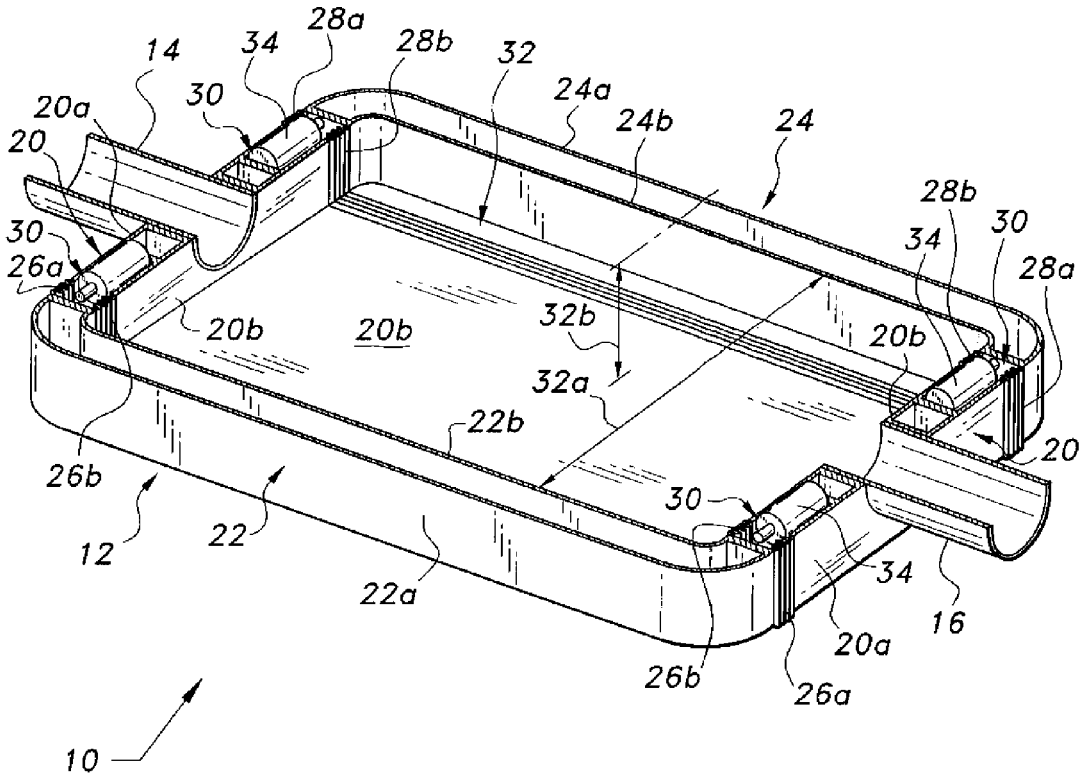
FIG. 1A is a top perspective view in section of an expandable chamber acoustic silencer according to the present invention, illustrating its internal structure.
Figure 1B:
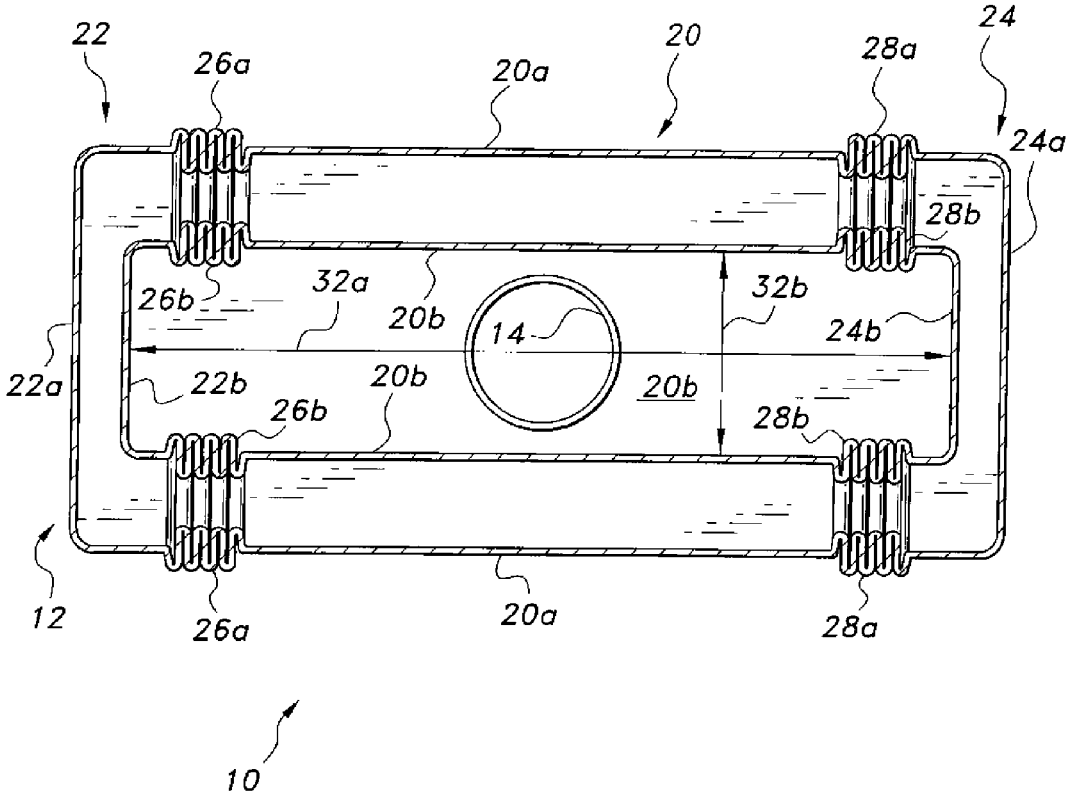
FIG. 1B is an elevation view in section of the expandable chamber acoustic silencer of FIG. 1A according to the present invention, particularly illustrating its internal cross-sectional area.
Figure 5:
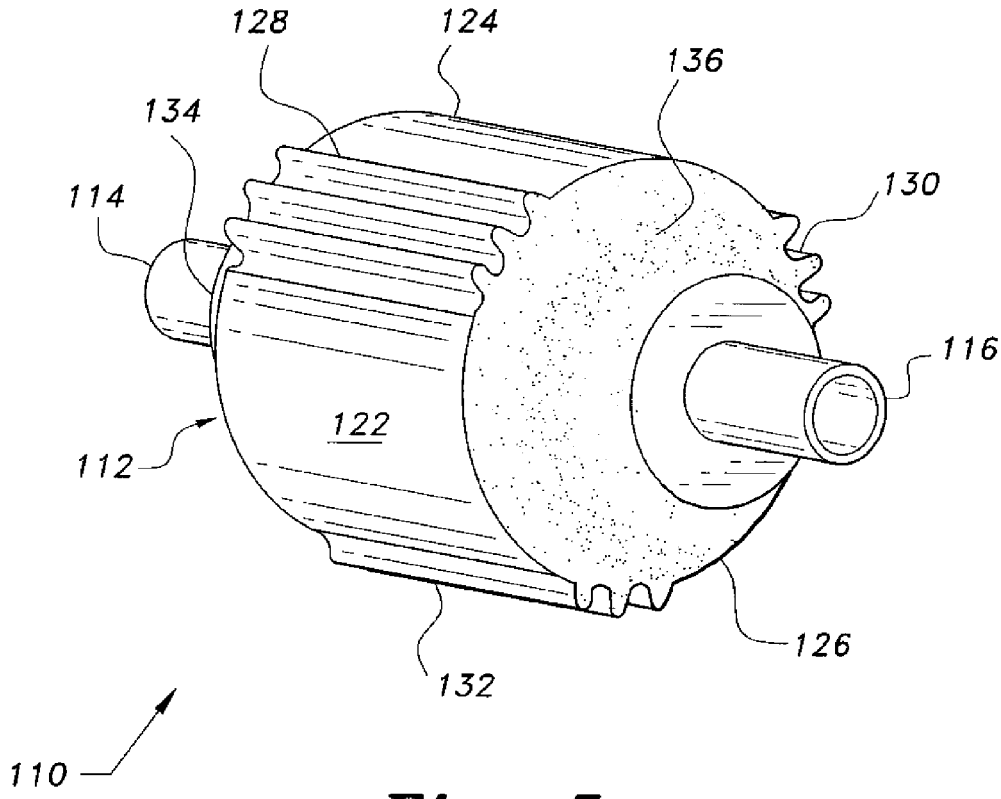
FIG. 5 is a perspective view of another embodiment of an expandable chamber acoustic silencer according to the present invention, wherein the device has a generally cylindrical configuration.

FIG. 1A of the drawings provides an illustration in section through the center of a first embodiment of an expandable chamber acoustic silencer, designated as silencer or muffler 10. It will be understood that the silencer 10 of FIG. 1A would normally be closed by additional structure that is a mirror image to the portion illustrated in FIG. 1A, thereby forming a substantially closed container 12. A lateral elevation view in section of such a closed silencer container 12 illustrating the variable internal cross-sectional area of the device is provided by FIG. 1B. An alternative embodiment differing primarily in external shape is illustrated in FIG. 5 of the drawings, which clearly shows the substantially closed configuration, except for the inlet and outlet. The silencer 10 of FIGS. 1A and 1B has a configuration suitable for use as a muffler for an internal combustion engine, having an inlet passage 14 and outlet passage 16. Conventional sound suppression means, (not shown) may be disposed within the closed container 12, e.g., dissipative material, loose glass fiber material, baffles, and/or other pipe or duct patterns or configurations, etc., but is omitted from the drawing for clarity.

The container 12 formed by the silencer 10 is defined by a fixed central wall portion 20 and by first and second movable wall portions 22 and 24 extending outwardly therefrom. Each wall portion, i.e., the single fixed wall portion 20 and the two movable wall portions 22 and 24, may be formed of an inner panel and an outer panel. The wall portion 20 of FIGS. 1A and 1B thus includes outer panel 20*a* and inner panel 20*b*. The first movable wall portion 22 comprises movable first outer panel 22*a* and movable first inner panel 22*b*, and the second movable wall portion 24 comprises movable second outer panel 24*a* and movable second inner panel 24*b*. First outer and inner flexibly expandable portions or members 26*a* and 26*b* join the respective first outer and inner panels 22*a*, 22*b* to the respective outer and inner panels 20*a* and 20*b*, and second outer and inner flexibly expandable portions or members 28*a* and 28*b* connect the respective second outer and inner panels 24*a*, 24*b* to the respective outer and inner panels 20*a* and 20*b*. The flexibly expandable material may be any suitable material, including resilient elastomers for silencer applications where high temperatures are not a concern. As the flexibly expandable material stretches and retracts in accordance with a mechanism described further below, the internal cross-sectional area of the device is varied or adjusted accordingly, as shown in FIGS. 2A through 4.

The spans between the various outer and inner panels, and particularly the outer and inner panels 20*a* and 20*b*, define an actuator housing 30 therebetween, for housing or containing the actuators of the system, as discussed further below. The wall portion 20, movable wall portions 22 and 24, and flexibly expandable portions 26*a*, 26*b*, 28*a*, and 28*b* define the variable internal width 32*a* of the device, with the internal height of the container 12 being indicated by the vertical dimension 32*b* in FIGS. 1A and 1B, (The lower limit of the vertical dimension 32*b* in FIG. 1A is the inner panel 20*b*, the upper limit being designated by a line representing the opposite upper surface of the inner panel 20*b*, not shown in FIG. 1A.) These two mutually orthogonal dimensions 32*a* and 32*b*, when taken together, define the variable internal cross-sectional area of the silencer 10. As the movable wall portions 22 and 24 are moved outwardly and inwardly by the mechanism described further below, the internal width 32*a*, and accordingly the internal cross-sectional area, is varied accordingly to adjust the resonance cavity of the device according to the sound input to the device, thereby reducing the audible output from the silencer 10.

Figure 2A:
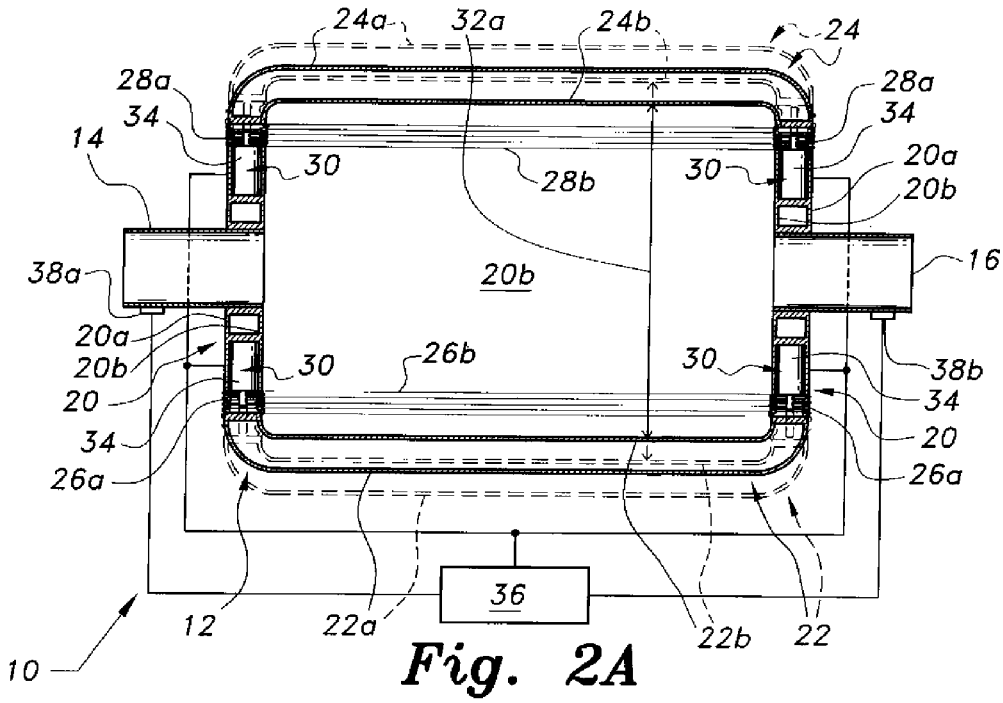
FIG. 2A is a top plan view in section of the expandable chamber acoustic silencer of FIG. 1, including a schematic representation of an electronic control system having both input and output sound level detection microphones.
Figure 2B:
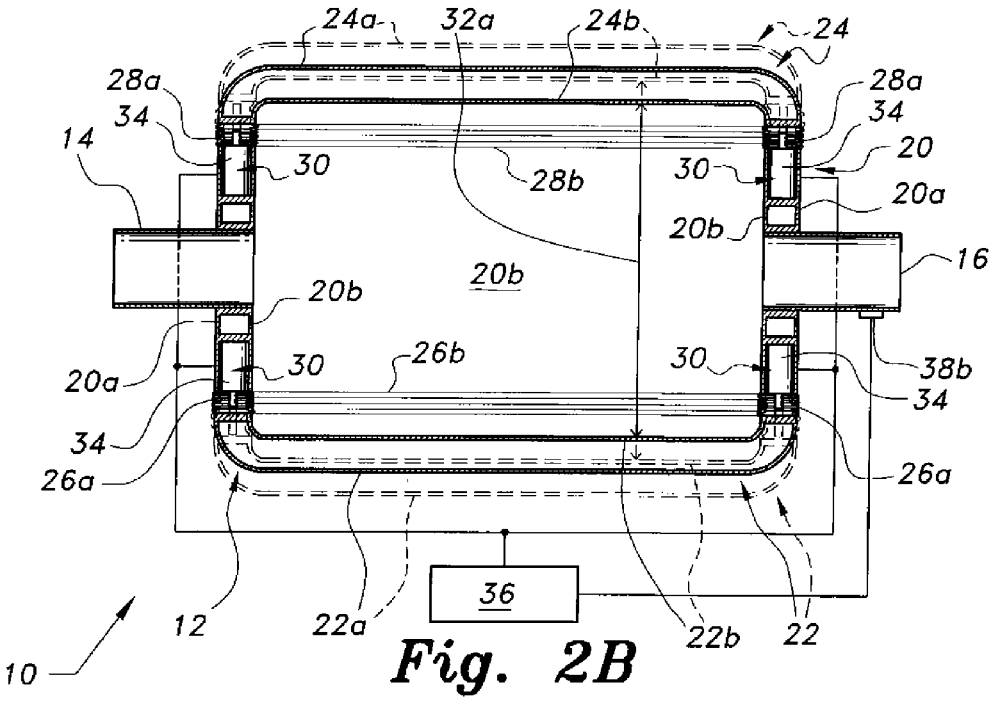
FIG. 2B is a top plan view in section of the expandable chamber acoustic silencer of FIG. 1, including a schematic representation of an electronic control system having only an output sound level detection microphone.

FIGS. 2A and 2B illustrate two embodiments of the silencer 10, which differ only in the location(s) of the microphone or microphones used to detect the sound level being processed by the device. The basic physical structure of the silencer 10 of FIGS. 2A and 2B is the same as that illustrated in FIGS. 1A and 1B, corresponding designations being used to designate corresponding components. The actuator housings 30 between the inner and outer panels of the container walls have actuators 34 installed therein. The actuators 34 may comprise any practicable type of actuator, e.g., electrically powered, pneumatic, hydraulic, etc. Preferably, the actuators 34 comprise conventional electromechanical linear actuators, in which a shaft selectively extends linearly from the actuator body when an appropriate electrical signal is received to drive the actuator 34. The actuators 34 may be located within cavities or housings 30 within the fixed wall structure 20 of the device, their shafts being connected to structure within the two movable wall structures 22 and 24 to selectively expand those walls outwardly or retract them inwardly.

An actuator controller 36 is provided with the system, the controller 36 being connected to and communicating electrically with the actuators 34. The controller 36, in turn, receives and processes acoustic signals from one or more microphones associated with the system. In FIG. 2A, a first microphone 38*a* is located at the inlet 14 of the silencer 10, and a second microphone 38*b* is located at the outlet 18 of the silencer 10 (i.e., a feedforward system). These two microphones 38*a* and 38*b* pick up acoustic signals from the inlet 14 and from the outlet 18, respectively, of the silencer 10, and transmit those signals electronically to the controller 36. The controller 36 processes those signals and transmits appropriate commands to the actuators 30. The controller 36 processes the signals received from the microphone(s), and commands the actuators 30 correspondingly. The actuators 34 then extend or retract to drive the movable walls 22 and 24 outwardly or inwardly, thereby adjusting the interior cross-sectional area 32 of the silencer 10 to control the sound output from the silencer 10.

The controller 36 processes the signals received from the microphone(s) 38*a*, 38*b* in accordance with the algorithm:

$$TL = 10\log_{10}\left|1+\frac{1}{4}(m-1/m)^2\sin^2 kL\right|^2 \quad \text{where } k=\frac{2\pi}{\lambda}=\frac{2\pi f}{c}$$

and $m=A_2/A_1$ in which TL is the Transmission Loss, $A_2$ is the cross sectional area of the container 12 as defined by the variable internal width 32*a* and the internal height 32*b*, $A_1$ is the cross sectional area of inlet passage 14, f is the sound frequency, c is the velocity of sound in the working medium (e.g., air), and L is the length of the container 12, λ is the wavelength of the sound wave, and k is the wavenumber. It will be readily apparent that the Transmission Loss TL depends upon the ratio m between the cross-sectional area $A_2$ of the container 12 and the cross-sectional area $A_1$ of the inlet, so that automatically adjusting the cross-sectional area of the container 12 while the cross-sectional area of the inlet 14 remains fixed permits the reactance of the expansion chamber to be adjusted so that the transmission loss cancels the noise when the noise level changes.

FIG. 2B is nearly identical to FIG. 2A, with the exception that the silencer 10 and control system of FIG. 2B includes only a single microphone 38*b* (i.e., a feedback only system) located at the outlet 18 of the device. It should be noted that the electrical wiring illustrated in FIGS. 2A and 2B is intended as a schematic illustration only, and is shown to the exterior of the internal cavity or space between the inner and outer panels of the device for clarity in the drawings. It is anticipated that the actual wiring could be placed between the inner and outer panels to produce a neater installation, depending upon the temperature to which the silencer device is to be subjected.

Figure 3:
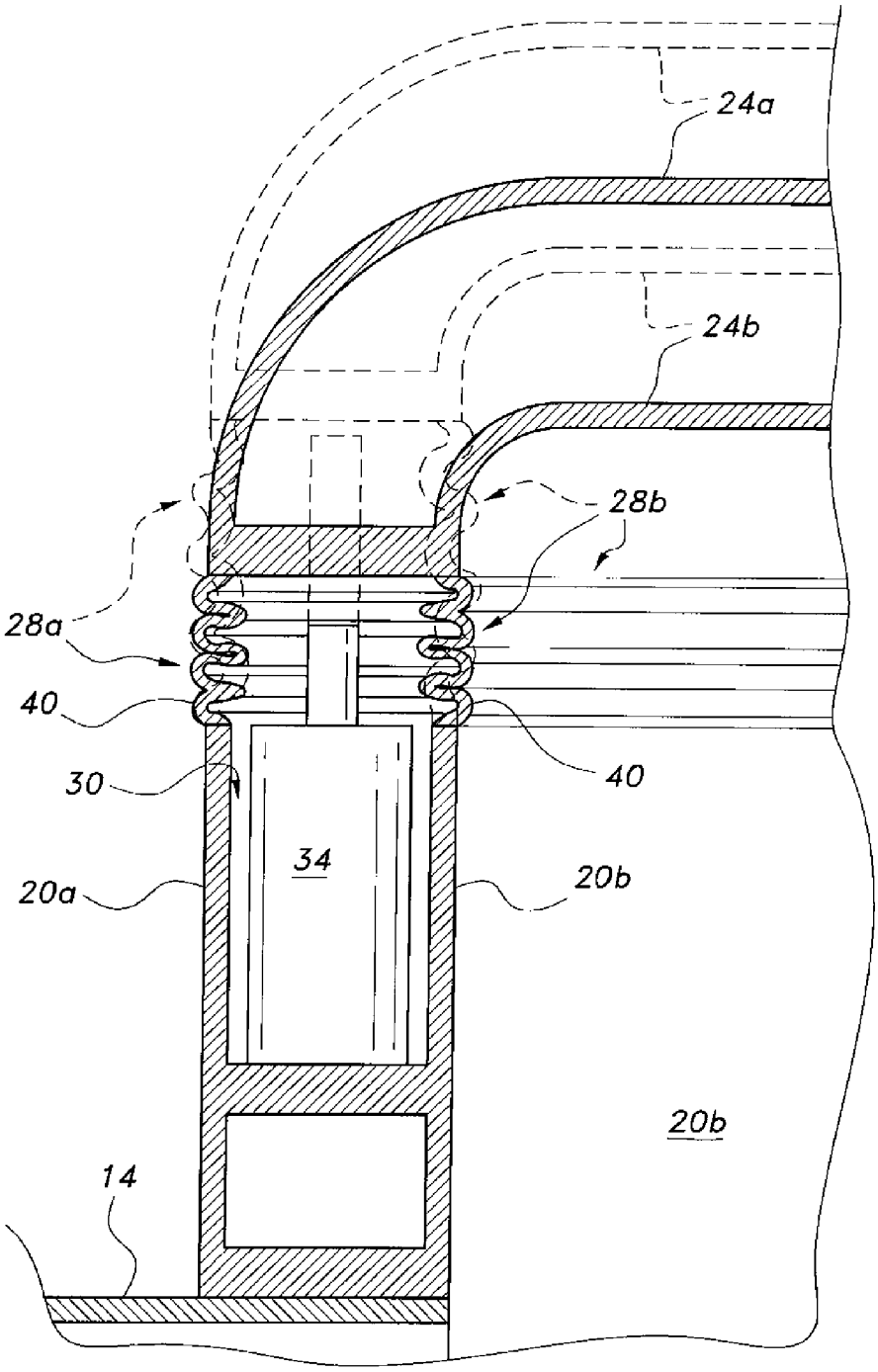
FIG. 3 is a partial top detail view in section of one corner of an expandable chamber acoustic silencer according to the present invention, illustrating a first embodiment of an expandable wall section incorporating a resilient material.
Figure 4:
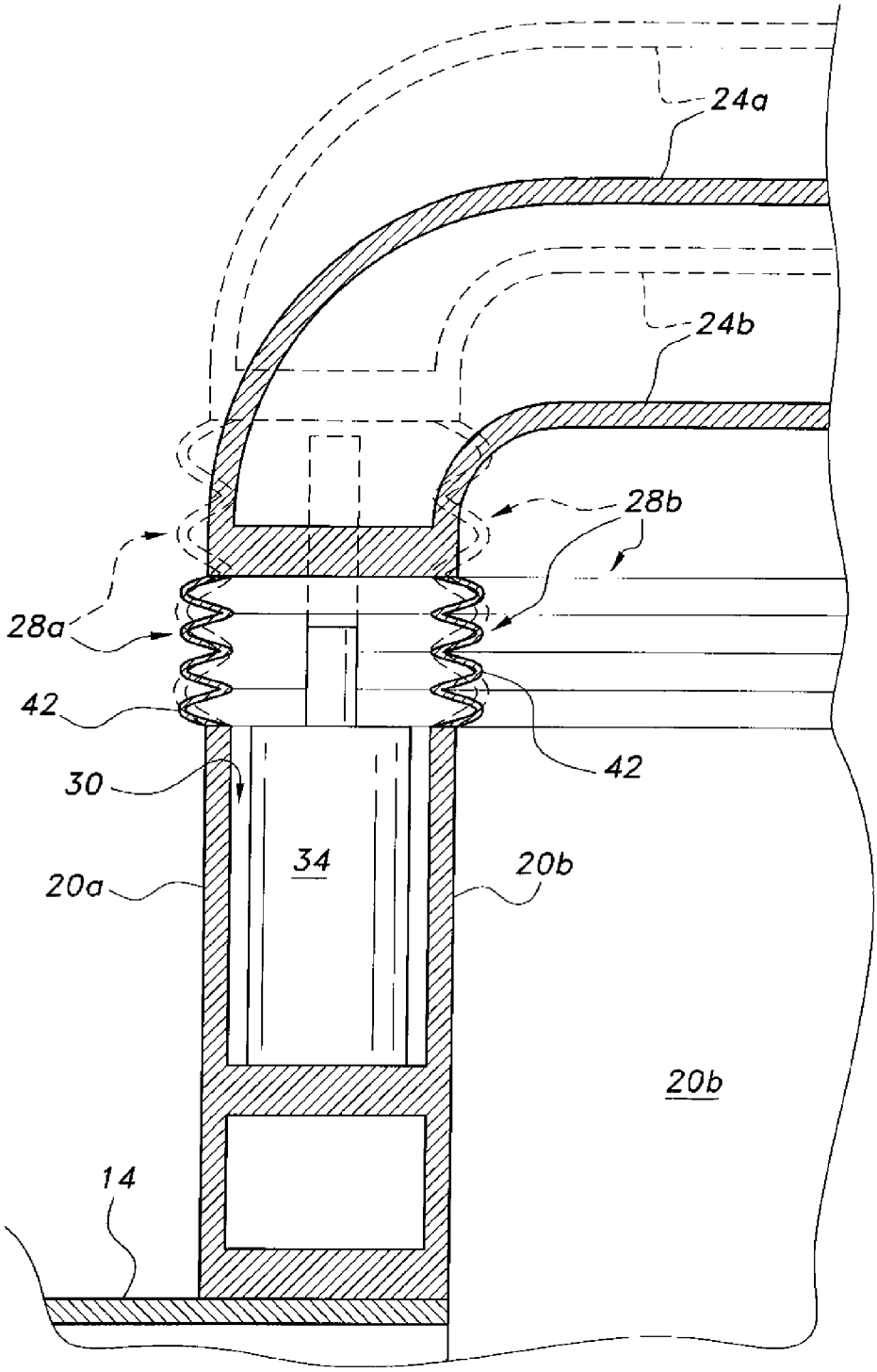
FIG. 4 is a partial top detail view in section of one corner of an expandable chamber acoustic silencer according to the present invention, illustrating a second embodiment of an expandable wall section incorporating a metal bellows material.

FIGS. 3 and 4 provide details of an exemplary actuator installation and alternative materials that may be used to form the expandable sections of the device. The basic structure of the silencer illustrated in both FIGS. 3 and 4 is substantially identical to that illustrated in FIGS. 1A, 1B, 2A, and 2B, with only the material of the flexibly expandable portions differing between the two Figures. In FIG. 3, a resilient and flexible elastomer material 40 is used to form the flexibly expandable portions 28*a* and 28*b* of the device, it being understood that the silencer device of FIG. 3 would not be used in high temperature installations due to the relatively low melting point of such elastomer material 40. However, the silencer device of FIG. 4 incorporates a flexible corrugated metal bellows 42 for the flexibly expandable portions 28*a*, 28*b*. Such material 42 is not as subject to deterioration at high temperatures as the elastomer material 40 used in the silencer of FIG. 3, and therefore the silencer of FIG. 4 might be incorporated in the exhaust system of an internal combustion engine.

Figure 6:
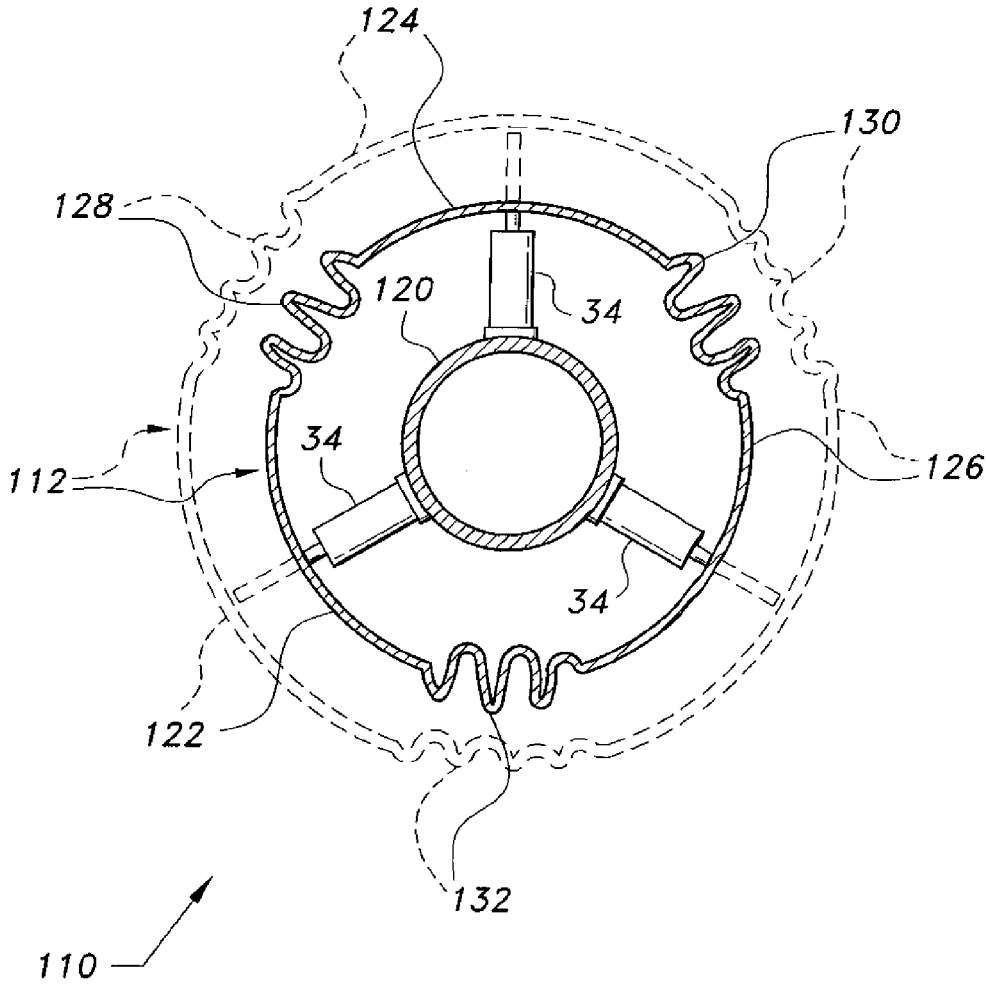
FIG. 6 is a diametric cross-sectional view of the expandable chamber acoustic silencer of FIG. 5, illustrating its general internal structure.

FIGS. 5 and 6 of the drawings illustrate another embodiment of the silencer, designated as silencer 110. The silencer 110 of FIGS. 5 and 6 has a generally cylindrical configuration for its container 112, as opposed to the generally rectangular parallelepiped (with rounded corners) configuration of the silencer 10. However, the same basic principles of operation apply to both silencers 10 and 110. The silencer 110 includes a fixed central inner wall or panel 120 that may also serve as at least a portion of the sound suppression structure of the device. A plurality of rigid but movable arcuate outer wall panel sections 122, 124, and 126 extend circumferentially about the central inner wall 120, the arcuate sections 122 through 126 being joined by corresponding flexible sections 128, 130, and 132 to form a complete cylindrical shape. The ends of the cylinder are closed about the inlet 114 and outlet 116 by first and second flexible panels 134 and 136 to close the container 112. The flexible materials used for the sections or panels 128 through 136 may comprise resilient elastomer materials for relatively low temperature use, or flexible metal for high temperature use, with the end panels 134 and 136 each having a series of circumferential corrugations in such a construction.

The actuators 34 may be identical to the actuators 34 of the embodiments of FIGS. 1A through 4, but are arranged radially within the variable internal volume of the cylindrical silencer 110. The actuators 34 are anchored at their inboard ends to the fixed inner wall panel 120, and each of the actuators extends radially outward to connect to and drive one of the rigid arcuate outer wall panel sections 122 through 126. The control system, comprising one or more microphones and a controller, is substantially the same as that provided for the embodiments illustrated in FIGS. 2A and 2B. Operation of the cylindrical silencer embodiment 110 of FIGS. 5 and 6 is substantially the same as that of the rectangular parallelepiped embodiments of FIGS. 1A through 4. However, the function of each of the embodiments described herein is substantially the same, the actuators being adjusted inward and outward by the controller in accordance with signals received from the microphone(s) to adjust the variable internal cross-sectional area of the expansion chamber silencer device, thereby reducing the sound output level of the silencer.

It is to be understood that the present invention is not limited to the embodiments described above, but encompasses any and all embodiments within the scope of the following claims.

I claim:

1. An expandable chamber acoustic silencer, comprising:

a substantially closed container having at least one fixed wall portion, at least one movable wall portion, and at least one flexibly expandable portion between the fixed wall portion and the movable wall portion, the fixed wall portion, the movable wall portion, and the flexibly expandable portion defining a variable internal cross-sectional area for the container, the container further having an inlet passage and an outlet passage, the inlet passage and the outlet passage each having a fixed cross-sectional area, the inlet passage and the container defining an expansion chamber, wherein at least one actuator housing is formed within the at least one fixed wall portion, the at least one actuator housing being in open communication with the at least one flexibly expandable portion;

at least one microphone mounted to the container;

an actuator controller, the controller receiving signals from the microphone; and at least one actuator being received within the at least one actuator housing, the actuator receiving signals from the controller and adjusting the at least one movable wall portion relative to the at least one fixed wall portion, and thereby the corresponding internal cross-sectional area of the container relative to the fixed cross-sectional areas of the inlet passage in accordance with the signals received from the controller to automatically adjust acoustic transmission loss in the expansion chamber to changes in noise level.

2. The expandable chamber acoustic silencer according to claim 1, wherein the at least one actuator comprises a plurality of electromechanical linear actuators.

3. The expandable chamber acoustic silencer according to claim 1, wherein the flexibly expandable portion is a resilient elastomer.

4. The expandable chamber acoustic silencer according to claim 1, wherein the flexibly expandable portion is formed of corrugated metal.

5. The expandable chamber acoustic silencer according to claim 1, wherein the at least one microphone is installed external to a corresponding one of the inlet passage and outlet passage.

6. The expandable chamber acoustic silencer according to claim 1, wherein the container has a form selected from the group consisting of rectangular parallelepipeds and cylinders.

7. An expandable chamber acoustic silencer, comprising:

a substantially closed container formed by at least one wall, the at least one wall having at least one fixed wall portion, at least one movable wall portion, and at least one flexibly expandable portion between the fixed wall portion and the movable wall portion, the fixed wall portion, the movable wall portion, and the flexibly expandable portion defining a variable internal cross-sectional area of the container, the container further having an inlet passage and an outlet passage, the inlet passage and the outlet passage each having a fixed cross-sectional area, the container having a larger cross-sectional area than the inlet passage, thereby defining an expansion chamber, wherein at least one actuator housing is formed within the at least one fixed wall portion, the at least one actuator housing being in open communication with the at least one flexibly expandable portion; and at least one electromechanical linear actuator received within the at least one actuator housing, the at least one electromechanical linear actuator selectively adjusting the movable wall portion relative to the fixed wall portion and the corresponding internal cross-sectional area of the container, and thereby the corresponding internal cross-sectional area of the container relative to the fixed cross-sectional area of the inlet passage to adjust acoustic transmission loss in the expansion chamber to changes in noise level to adjust acoustic transmission loss in the expansion chamber to changes in noise level.

8. The expandable chamber acoustic silencer according to claim 7, further comprising:

at least one microphone installed external to a corresponding one of the inlet passage and outlet passage; and an actuator controller, the controller receiving signals from the microphone, the at least one electromechanical linear actuator receiving signals from the controller.

9. The expandable chamber acoustic silencer according to claim 7, wherein the flexibly expandable portion of the at least one wall is a resilient elastomer.

10. The expandable chamber acoustic silencer according to claim 7, wherein the flexibly expandable portion of the at least one wall is formed of corrugated metal.

11. The expandable chamber acoustic silencer according to claim 7, wherein the at least one wall of the container has a form selected from the group consisting of rectangular parallelepipeds and cylinders.

* * * * *